United States Patent [19]

Lawson et al.

[11] Patent Number: 4,809,528

[45] Date of Patent: Mar. 7, 1989

[54] HOT STRIP MILL

[75] Inventors: Kenneth T. Lawson, Sheffield; Thomas Hope, Doncaster, both of United Kingdom

[73] Assignee: Davy McKee (Sheffield) Limited, Sheffield, England

[21] Appl. No.: 91,050

[22] Filed: Aug. 28, 1987

[30] Foreign Application Priority Data

Sep. 1, 1986 [GB] United Kingdom ..... 8621102

[51] Int. Cl.[4] ..... B21B 37/06

[52] U.S. Cl. ..... 72/17; 72/205; 72/234

[58] Field of Search ..... 72/17, 205, 234

[56] References Cited

U.S. PATENT DOCUMENTS

| | | | |
|---|---|---|---|
| 3,839,888 | 10/1974 | Greenberger | 72/17 |
| 4,339,934 | 7/1982 | Mitchell | 72/17 |
| 4,463,586 | 8/1984 | Griffin | 72/17 |

FOREIGN PATENT DOCUMENTS 1564389 4/1980 United Kingdom .

*Primary Examiner*—Robert L. Spruill
*Assistant Examiner*—Steven Katz
*Attorney, Agent, or Firm*—Lee & Smith

[57] ABSTRACT

A multi-stand hot strip rolling mill has a pinch roll assembly downstream of the last stand and before the coiler and a shapemeter roll is located between the last stand and the pinch roll assembly so as to engage with the strip.

3 Claims, 2 Drawing Sheets

HOT STRIP MILL

BACKGROUND OF THE INVENTION

This invention relates to a multi-stand hot strip rolling mill.

During the hot rolling of metal strip, particularly steel strip, in a multi-stand rolling mill, the rolling may introduce defects into the strip so that the resultant strip, instead of being flat, has wavy edges or similar defects. Strip having such defects is unacceptable to many users and consequently it is necessary to make sure that the hot rolled strip is, as far as possible, free from these defects.

It has become a common practice in multi-stand cold strip rolling mills to provide a shapemeter for measuring strip shape immediately after the last stand of the mill. The strip is held under tension between the last stand and the coiler and the shapemeter engages the strip across its width so that the strip is deflected slightly and the shapemeter measures the components of strip tension across the width of the strip. The shape of the strip when free from tension can be deduced from the measured tension distribution, for example, if the tension distribution is uniform then the strip will be essentially flat when the tension is released. On the other hand, if the tension distribution across the width of the strip is not uniform then the strip will not be flat when the tension is released. Shape signals from the shapemeter are used to automatically adjust various control features on one or more stands of the mill so as to substantially eliminate the shape errors and so produce flat strip.

In British Patent Specification No. 1564389 there is disclosed a shapemeter for determining the degree of flatness of a metal strip during hot rolling thereof. The specification discloses that the metal strip being rolled passes over a plurality of individual sensing rollers arranged substantially side by side across the path taken by the strip. There is no disclosure in the specification as to exactly where the apparatus is positioned when the strip is being rolled in a multi-stand rolling mill. From a practical consideration it is believed that the apparatus is positioned between a pair of adjacent stands of the multi-stand rolling mill.

If the apparatus is positioned between the last two stands of the multi-stand rolling mill then any defects introduced into the strip at the last stand are not detected by the apparatus. One of the problems with a hot strip rolling mill is that there is a considerable distance between the last stand of the hot mill and the coiler in order to accomodate means for water cooling of the strip and this distance may be in the excess of 100 meters. For this reason if it is proposed to place a shapemeter roll downstream of, but close to the last stand of the hot mill, the shapemeter will not become effective until strip has been taken up by the coiler and tension has been developed in the strip. Consequently 100 meters or more of the strip is wasted before the control system operated by the shapemeter becomes operative.

SUMMARY OF THE INVENTION

It is an object of the present invention to overcome this problem and reduce the wastage of unsatisfactory strip which is rolled before the shapemeter become operative.

According to the present invention a multi-stand hot strip rolling mill has a shapemeter roll positionable to engage with strip being rolled and is characterized in that a pinch roll assembly is located downstream of the least stand, but close thereto, said assembly having a pair of driven rolls and means for adjusting the rolls between positions in which the rolls engage opposite faces of strip issuing from the last stand to apply tension thereto and in which the strip is permitted to pass between the rolls without having tension applied thereto respectively, and the shapemeter roll is located between the last stand and the pinch roll assembly.

In this way the distance between the last mill stand and the position where tension is applied to the strip is reduced considerably and by positioning the shapemeter roll between the last stand and the pinch roll assembly, the shapemeter roll becomes effective as soon as tension is generated in the strip.

BRIEF DESCRIPTION OF THE DRAWING

In order that the invention may be more readily understood, it will now be described, by way of example only, with reference to the accompanying drawings, in which.

DESCRIPTION OF THE PREFERRED EMBODIMENTS

Figure 1:
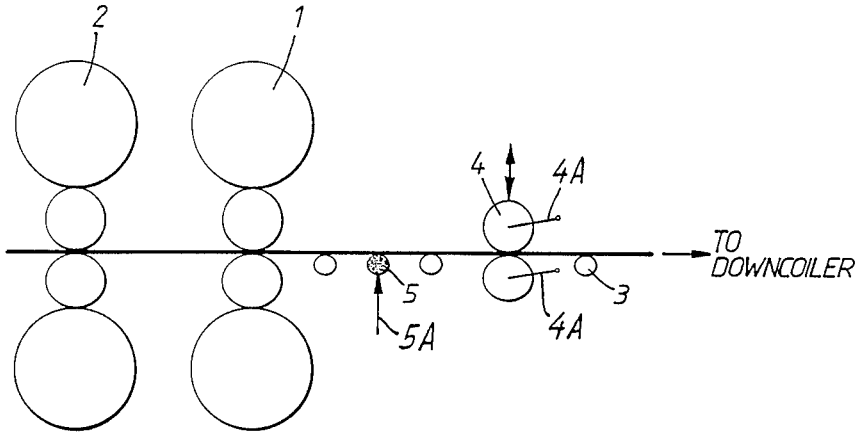
FIGS. 1 and 3 are diagrammatic side elevations of the last stands of a multi-stand hot strip rolling mill in accordance with the present invention and as shown during threading of the strip.
Figure 2:
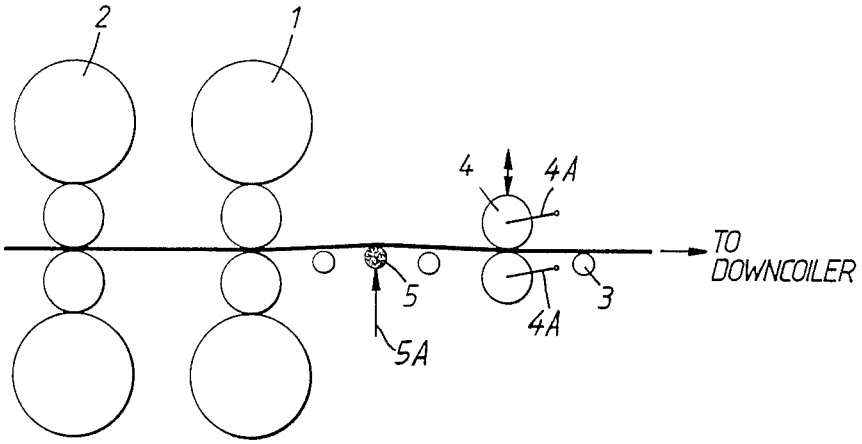
FIGS. 2 and 4 are diagrammatic side elevations of the same multi-stand hot strip rolling mill after threading of the strip.

Referring to FIGS. 1 to 4, reference numeral 1 indicates the last stand of a multi-stand hot strip mill and reference 2 indicates the penultimate stand. Downstream of the last stand there is a run out table 3 and means (not shown) are provided for cooling the strip issuing from the mill as it passes down the run out table. At the far end of the run out table, away from the last stand of the mill, there is a down coiler assembly for the strip. Downstream of the last stand and at the input end of the run out table 3 there is a strip tensioning device in the form of a pinch roll assembly 4 consisting of a pair of rolls movable into and out of engagement with opposite faces of the strip. Drive means 4A serve to drive the rolls. A shapemeter roll 5 is positioned between the last stand 1 and the pinch roll assembly 4.

As shown in FIG. 1, when the leading end of the strip issues from the last stand 1 of the rolling mill, the shapemeter roll is retracted downwardly so as not to hinder the passage of the strip and the pinch rolls are separated to allow the leading end of the strip to pass therebetween on its way to the down coiler. The pinch rolls are rotated at a speed equal to or slightly greater than the issue speed of the strip from the last stand and the pinch rolls are then closed onto opposite faces of the strip in order to apply tension to the portion of the strip between the last stand and the pinch rolls. At the same time the shapemeter roll 5 is raised by means 5A so as to engage with the underside of the strip between the last stand and the pinch rolls. The signals obtained from the shapemeter are used to control the operation of at least the last stand of the mill in order to roll strip with reduced tension variations across its width and hence improved shape. For example the signals from the shapemeter roll may be used to adjust the roll gap between the work rolls at one end of the last stand with respect to the opposite ends so as to steer the strip. Alternatively bending may be applied to the work rolls or coolant may be differentially applied to the work rolls in order to change their shape.

Figure 3:
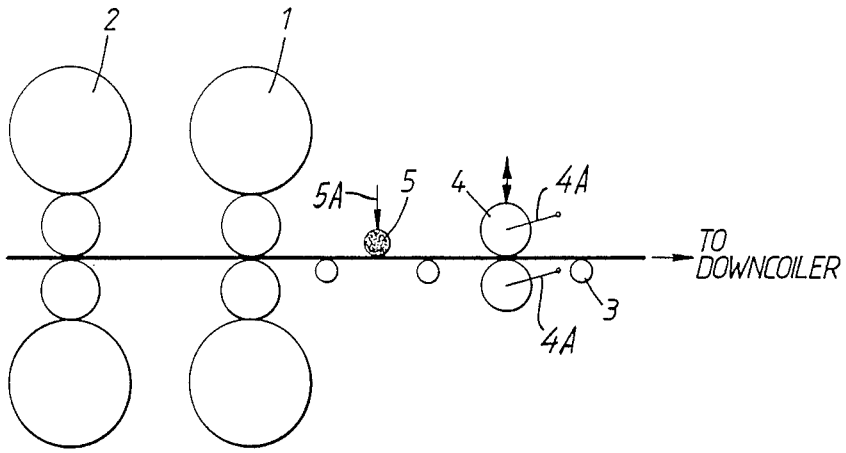
Figure 4:
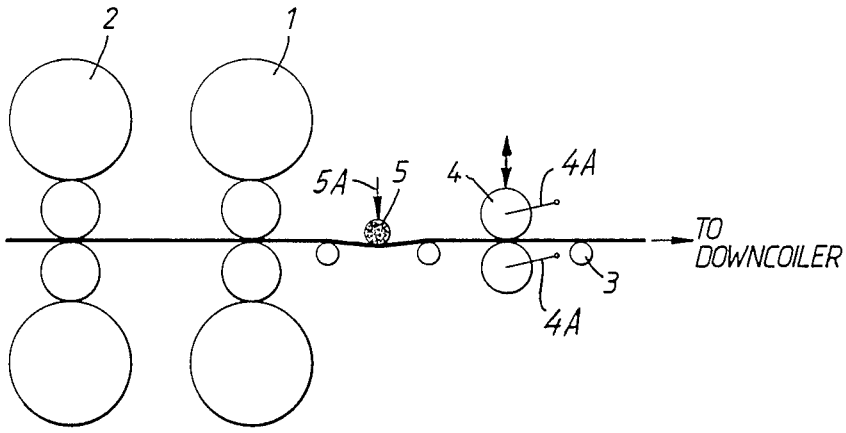

As shown in FIGS. 3 and 4 the shapemeter roll may be located above the path taken by the strip and after the strip has been gripped by the pinch rolls the shapemeter roll is lowered into engagement with the upper face of the strip.

When sufficient strip has been rolled for it to pass beyond the pinch roll assembly to the coiler at the end of the runner table, it is wound onto the coiler and once two or three turns have been wound onto the coiler drum the drum can be accelerated to provide tension in the strip. The pinch rolls can then be opened slightly in order to reduce the contact pressure between the pinch rolls and the strip to minimize any marking of the faces of the strip. The top pinch roll is kept close to its working position to maintain the direct angle of wrap between the strip and the shapemeter roll.

Use of the pinch roll assembly along with the shapemeter roll makes it possible to control the shape of the strip issuing from a hot strip mill as effectively as it can now be achieved in a cold mill.

A shapemeter roll suitable for use with a multi-stand hot rolling mill is disclosed in the above mentioned British Patent Specification.

What is claimed is:

1. The combination of a multi-stand hot strip rolling mill; a shapemeter roll located downstream of the last stand of the rolling mill, said roll being movable between a first position in which it engages with metal strip leaving the last stand to detect variation in tension across the width of the strip and a second position in which it is spaced from metal strip leaving the last stand; and a pinch roll assembly located downstream of the shapemeter roll, said assembly comprising a pair of driven rolls which are movable between a first position in which the rolls engage opposite faces of the strip to apply tension to the portion of the strip extending from the last stand of the mill to the pinch rolls and a second position in which the strip is permitted to pass between the rolls without having tension applied thereto.

2. The combination as claimed in claim 1, in which the shapemeter roll is positioned beneath the path taken by the strip issuing from the last stand and means are provided for displacing the roll into and out of engagement with the underside of the metal strip.

3. The combination claimed in claim 1, in which the shapemeter roll is positioned above the path taken by the strip issuing from the last stand and means are provided for displacing the roll into and out of engagement with the upperside of the metal strip.

* * * * *